United States Patent [19]

Guindon

[11] Patent Number: 5,058,289

[45] Date of Patent: Oct. 22, 1991

[54] GARMENT DRYING APPARATUS

[76] Inventor: Alain Guindon, R.R. #1 Kitigan, Kapuskasing, Ontario, Canada, P5N 2X7

[21] Appl. No.: 500,042

[22] Filed: Mar. 27, 1990

[30] Foreign Application Priority Data

Mar. 29, 1989 [CA] Canada ..... 594984

[51] Int. Cl.[5] ..... F26B 25/00

[52] U.S. Cl. ..... 34/104; 34/151; 34/239

[58] Field of Search ..... 34/104, 151, 91, 90, 34/21, 243 R, 239

[56] References Cited

U.S. PATENT DOCUMENTS

| | | | |
|---|---|---|---|
| 2,465,362 | 3/1949 | Elliott | 34/104 |
| 2,614,337 | 10/1952 | Darbo | 34/104 |
| 3,154,392 | 10/1964 | Littman | 34/104 |
| 3,203,112 | 8/1965 | Edmonds | 34/104 |
| 3,213,479 | 10/1965 | Wilkie | 15/304 |
| 3,299,529 | 1/1967 | Roberts et al. | 34/104 |
| 3,513,564 | 5/1970 | Gramprie | 34/104 |
| 3,645,009 | 2/1972 | Ketchem | 34/104 |
| 3,706,824 | 12/1972 | Huber et al. | 263/2 R |
| 3,793,744 | 2/1974 | Saita | 34/104 |
| 3,798,788 | 3/1974 | Kuntz | 34/104 |
| 3,999,304 | 12/1976 | Doty | 34/82 |
| 4,035,927 | 7/1977 | Spiegel | 34/163 |
| 4,085,519 | 4/1978 | Masika | 34/104 |
| 4,171,580 | 10/1979 | Vabrinskas | 34/104 |
| 4,198,765 | 4/1980 | Niyamae | 34/104 |
| 4,265,030 | 5/1981 | Smallegan | 34/104 |
| 4,596,078 | 6/1986 | McCartney | 34/104 |
| 4,768,293 | 9/1988 | Kaffka | 34/104 |
| 4,787,153 | 11/1988 | Chen | 34/239 |

FOREIGN PATENT DOCUMENTS

| | | | |
|---|---|---|---|
| 472733 | 5/1947 | Canada . | |
| 554815 | 3/1958 | Canada . | |
| 686901 | 5/1964 | Canada . | |
| 699181 | 12/1964 | Canada . | |
| 700170 | 12/1964 | Canada . | |
| 1026946 | 5/1974 | Canada . | |
| 1195840 | 1/1983 | Canada . | |
| 694904 | 7/1940 | Fed. Rep. of Germany | 34/104 |
| 2387312 | 8/1977 | France . | |
| 2115277 | 9/1983 | United Kingdom . | |

*Primary Examiner*—Henry A. Bennett
*Assistant Examiner*—Denise L. F. Gromada
*Attorney, Agent, or Firm*—Browdy and Neimark

[57] ABSTRACT

A device for drying garments comprises a bellows tube having a plurality of apertures throughout its length. The tube is used to support a garment and carry heated air from an air heating means to the inner surface of the garment.

3 Claims, 1 Drawing Sheet

GARMENT DRYING APPARATUS

FIELD OF THE INVENTION

This invention relates to an improvement in devices for drying garments.

BACKGROUND OF THE INVENTION

Several types of devices for drying garments are known in the prior art. For example U.S. Pat. No. 4,171,580 describes a boot dryer comprising a pair of flexible hoses adapted to be inserted into boots. The hoses are not perforated and the air enters and exits the hoses through the hoses' open ends.

U.S. Pat. No. 3,513,564 discloses a garment dryer comprising closed tubes provided with vents at one end thereof to channel the outlet of air flow through the tubes and through the articles being dried. The tubes are not flexible.

It is an object of the invention to provide a dryer adapted to dry garments of various shapes and forms.

SUMMARY OF THE INVENTION

According to a broad aspect, the invention relates to a device for drying garments of the type including support means for the garments and means for blowing a heated medium such as air to the support means. The improvement comprises support means having a plurality of apertures throughout its length for providing passage of the heated medium to the inner surface of said garment supported thereon. The structure of the support means is such that it can be oriented to generally conform to the configuration of at least a substantial portion of the inside of a garment supported thereby.

BRIEF DESCRIPTION OF THE DRAWINGS

The invention is illustrated by way of example in the accompanying drawings in which.

DESCRIPTION OF THE PREFERRED EMBODIMENT

Figure 1:
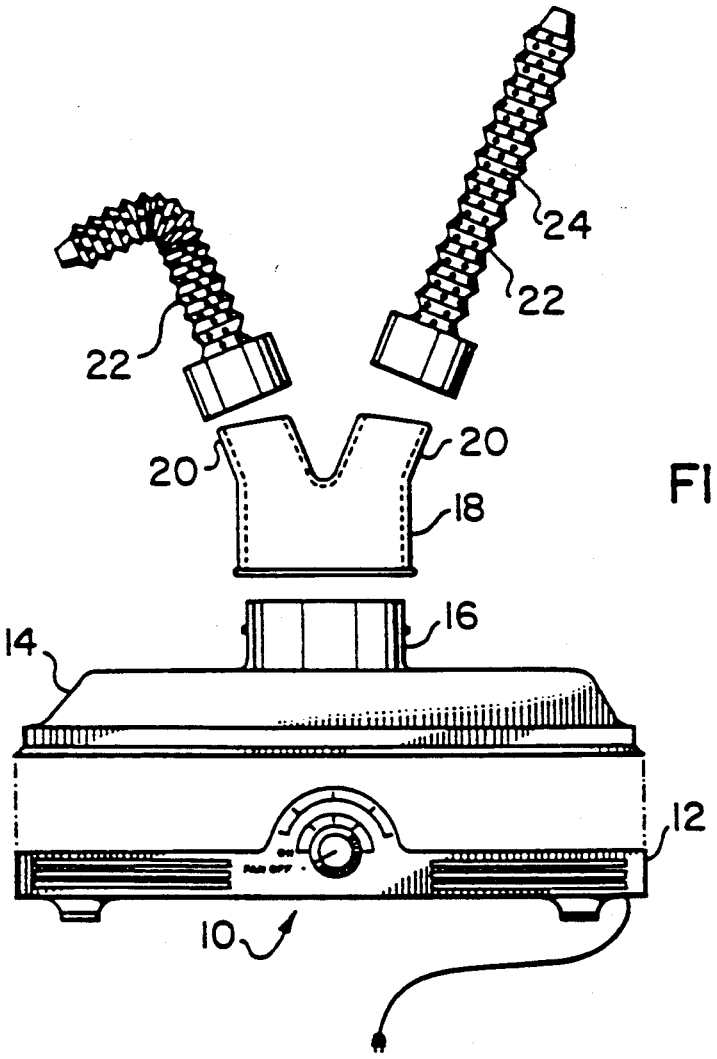
FIG. 1 is an exploded view of the device according to the present invention.

Referring to FIG. 1, a dryer indicated generally at 10 comprises a base 12 and an air plenum I4 mounted on the upper end thereof and having a primary, centrally located outlet 16. An adaptor 18 having, in the illustrated embodiment, two secondary outlets 20 fits over the primary outlet 16. A pair of bellows tubes 22 fit onto the outlets 20 of the adaptor 18.

The base 12 of the dryer 10 contains a heating coil and a blower (not shown) as well as a suitable timer and a temperature regulator. The bellows tubes 22 have a plurality of apertures 24 in the walls thereof and throughout their length which provides for the transmission of heated air currents from the interior of the tubes 22 to the interior of the garments supported thereby.

The bellows construction of tubes 22 provides flexibility thereto and thus the tubes can be oriented to conform to the configuration of a portion of the garment to be dried, such as the foot portion of a boot. Given that the tubes 22 are corrugated, they are extensible and retractible.

Figure 2:
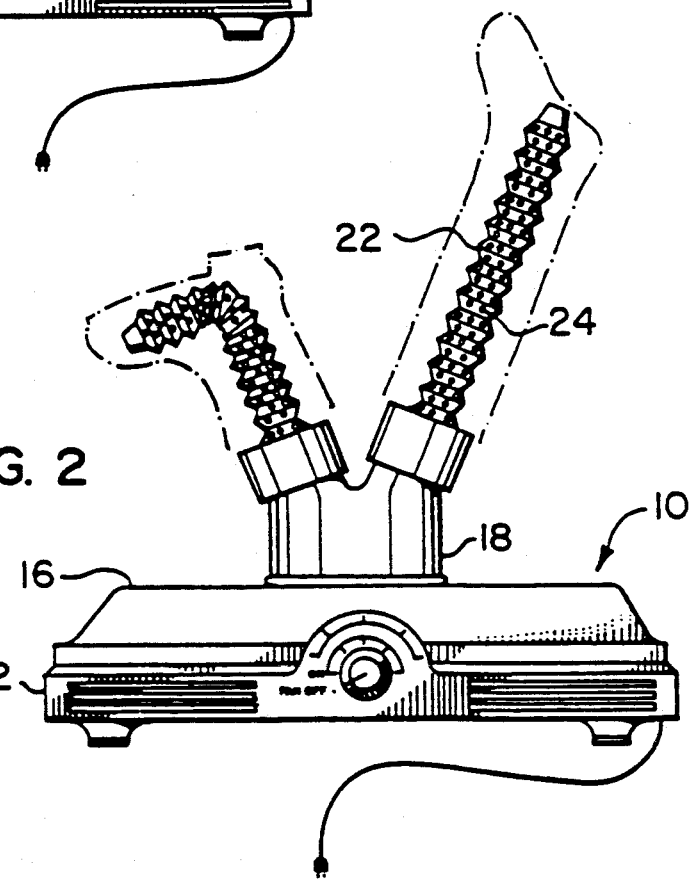
FIG. 2 is an elevation view of the device, the broken lines showing a boot and sock mounted in position for drying.

In use, as shown in FIG. 2, the bellows tubes 22 are placed inside the garment to be dried. Depending on the type of article to be dried, the tube is either extended or retracted.

The dryer is then actuated and the temperature of the heating coil adjusted, as desired. Warm air is thus blown through the secondary outlets 20 and the bellows tubes 22. The apertures 24 in the tubes 20 provide for the passage of the air to the inner surface of the garment and the garment is thus dried from the inside out.

While the present invention has been described in connection with a specific embodiment thereof and in a specific use, various modifications will occur to those skilled in the art without departing from the spirit and scope of the invention as set forth in the appended claims. I therefore wish to embody within the scope of the patent which may be granted hereon all such embodiments as reasonably and properly come within the scope of my contribution to the art.

The embodiments of the invention in which an exlcusive property or privilege is claimed are defined as follows:

1. In a device for drying garments of the type including support means for said garments and means for transmitting a heated medium to said support means, the improvement wherein said support means comprises an elongated, tubular, flexible member having a circumferential wall area of bellows-like construction, said support means having a plurality of apertures substantially throughout its length and its circumferential wall area, said apertures constituting means for providing passage of said heated medium therethrough to an inner surface of said garment supported thereon.

2. The device of claim 1 wherein the apertures in the walls of the support means are located such that the heated medium passed therethrough is broadly dispersed to said garment.

3. In a device fo drying garments comprising support means for supporting a garment to be dried and means for blowing hot air through said support means, the improvement wherein:

said support means comprises a circumferential wall defining an elongated, tubular, flexible member of bellow-like construction, said flexible member being bendable so that said support means can be flexibly oriented to generally conform to a configuration of at least a portion of the inside of a garment placed thereon for drying, said flexible member having a plurality of apertures extending therethrough and located substantially throughout its length and its circumference, said apertures constituting means for providing passage of said hot air therethrough to an inner surface of the garment being supported thereon.

* * * * *